US006104018A

United States Patent [19]

Varma et al.

[11] Patent Number: 6,104,018

[45] Date of Patent: Aug. 15, 2000

[54] UNIFORM BULK MATERIAL PROCESSING USING MULTIMODE MICROWAVE RADIATION

[75] Inventors: Ravi Varma, Los Alamos, N. Mex.; Worth E. Vaughn, Madison, Wis.

[73] Assignee: The United States of America as represented by the United States Department of Energy, Washington, D.C.

[21] Appl. No.: 09/336,047

[22] Filed: Jun. 18, 1999

[51] Int. Cl.[7] ..... H05B 6/70; H05B 6/74

[52] U.S. Cl. ..... 219/746; 219/750; 219/697; 219/738

[58] Field of Search ..... 219/746, 750, 219/748, 738, 741, 695, 696, 697, 756, 762

[56] References Cited

U.S. PATENT DOCUMENTS

| | | | |
|---|---|---|---|
| 3,465,114 | 9/1969 | Bleackley et al. | 219/746 |
| 4,673,782 | 6/1987 | Koepke et al. | 219/746 |
| 4,760,230 | 7/1988 | Hassler | 219/750 |
| 5,632,921 | 5/1997 | Risman et al. | 219/750 |
| 5,834,744 | 11/1998 | Risman | 219/697 |

*Primary Examiner*—Philip H. Leung
*Attorney, Agent, or Firm*—Samuel M. Freund; William R. Moser; Paul A. Gottlieb

[57] ABSTRACT

An apparatus for generating uniform heating in material contained in a cylindrical vessel is described. $TE_{10}$-mode microwave radiation is coupled into a cylindrical microwave transition such that microwave radiation having $TE_{11}$-, $TE_{01}$- and $TM_{01}$-cylindrical modes is excited therein. By adjusting the intensities of these modes, substantially uniform heating of materials contained in a cylindrical drum which is coupled to the microwave transition through a rotatable choke can be achieved. The use of a poor microwave absorbing insulating cylindrical insert, such as aluminum oxide, for separating the material in the container from the container walls and for providing a volume through which air is circulated is expected to maintain the container walls at room temperature. The use of layer of highly microwave absorbing material, such as SiC, inside of the insulating insert and facing the material to be heated is calculated to improve the heating pattern of the present apparatus.

13 Claims, 10 Drawing Sheets

UNIFORM BULK MATERIAL PROCESSING USING MULTIMODE MICROWAVE RADIATION

This invention was made with government support under Contract No. W-7405-ENG-36 awarded by the U.S. Department of Energy to The Regents of The University of California. The government has certain rights in the invention.

FIELD OF THE INVENTION

The present invention relates generally to the processing of material stored in cylindrical drums and, more particularly, to an apparatus for generating uniform microwave heating in cylindrical containers for bulk processing of the materials therein.

BACKGROUND OF THE INVENTION

Nuclear waste is generally processed by heating liquid, slurry, and sludge wastes to dryness, oxidation/destruction of organic materials contained therein followed by further heating, using microwaves, to yield oxides of the radioactive elements and other metals present. The oxides fraction may then be extracted in-situ into glass/ceramic matrices and immobilized by continued microwave heating in the presence of glass-fritts and ceramic former additives in the same reactor vessel at temperatures 600° C.–1450° C. Suitable waste forms are borosilicate glass and ceramics (synrocs or mixed zirconia/alumina-based ceramic calcines mixed with a fritt composition). The final product includes glass/ceramic monolith waste forms that can be safely disposed of. High-temperature thermal "melter" furnace/incinerator combinations are inefficient and unsafe, since they require removal of the wastes from their containers and because thermal heating is non-selective.

Microwave heating has many advantages over other forms of heating. For example, microwave heating is material-selective and provides bulk heating of the material from the inside out; it is rapid when there exists an efficient coupling (high-susceptiblity) of microwave energy into the material; and it can be applied to dangerous materials that are prone to become airborne, since microwave reactor systems can be operated as enclosed systems. Microwave energy interacts with materials by inducing rotations in molecules or in ion-pair dipoles, with subsequent conversion to heat. The microwave power, P, dissipated in bulk material as heat is given by the relationship, $P\ \pi\nu\epsilon' E^2 \tan\delta$ (W/m$^3$), where, E= electric field intensity at microwave frequency, $\nu$, $\epsilon'$ is the dielectric constant, and $\tan\delta=\epsilon''/\epsilon'$, where $\epsilon\epsilon$ is the dielectric loss constant.

Microwave processing technology is employed in the processing of nuclear and medical wastes. Much of this waste is stored in sealed drums for which heat processing has many advantages. For example, nuclear wastes can be calcined, sintered, or melted in the presence of ceramic precursors or glass fritt additives in the drums at temperatures ~1200° C. or higher at ambient pressure in order to immobilize the radionuclides from the waste in ceramic or glass matrices. In some instances, the material may be contaminated with harmful organic molecules which are destroyed by in-situ air oxidation in the same reactor prior to proceeding with the immobilization of the radioactive components. The resulting sintered materials are mechanically durable and non-leachable.

However, currently employed microwave processing technology is unable to provide uniform heating in materials to be heat-processed in the temperature range between 600 and 1450° C. in cylindrical cavity reactors, such as drum cavity reactors. For example, $TE_{10}$-mode microwave radiation (0.915 GHz, 50 kW) propagating through a rectangular WR975 waveguide and coupled through an adjustable iris plate interface located between the waveguide and the open end of a 55 gallon drum, is transformed essentially into a single, $TE_{11}$ cylindrical mode in the cylindrical drum. This mode deposits significant microwave energy near the drum center, but substantially less energy near the cylindrical outer wall of the drum. Powdered materials processed in such drum reactors have been observed to possess a monolithic structure near the center of the drum, while the powder near the drum wall was unaltered.

Accordingly, it is an object of the present invention to provide an apparatus for uniform heating of materials in cylindrical containers, 10–55 gallon drums, for example, using microwave radiation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus for generating uniform heating in material contained in a cylindrical vessel hereof may include: means for generating $TE_{10}$-mode microwave radiation in a waveguide; a cylindrical microwave transition having an axis, an open end and a closed end parallel thereto and perpendicular to the axis, the open end thereof disposed in the vicinity of an open end of the cylindrical vessel and approximately coextensive therewith such that the axis of the transition and the axis of the vessel are coaxial, for coupling microwave radiation thereinto, means for directing $TE_{10}$-mode radiation through the closed end of the cylindrical transition along the axis, whereby $TE_{11}$-mode microwave radiation is excited in the transition; means for directing $TE_{10}$-mode radiation through the side of the cylindrical transition such that the electric field of the $TE_{10}$-mode radiation is perpendicular to the axis of the transition, whereby the $TE_{01}$,-mode is excited in the transition; and means for directing $TE_{10}$-mode radiation through the side of the cylindrical transition such that the electric field of the $TE_{10}$-mode radiation is parallel to the axis of the transition, and the $TM_{01}$,-mode is excited in the transition; whereby $TE_{11}$-, $TE_{01}$-, and $TM_{01}$-mode microwave radiation are simultaneously coupled into the material contained in the cylindrical vessel, thereby uniformly heating the material.

Preferably, the $TE_{10}$-mode microwave radiation has a frequency between 0.915 and 2.45 GHz.

It is preferred that means are provided for adjusting the intensity of $TE_{10}$-mode radiation into each of the closed end and sides of the transition in order to improve the uniformity of heating of the material.

Preferably also, a layered low-loss-to-high-loss dielectric insulating cylindrical insert having a closed end is disposed within the cylindrical vessel to separate the interior of the cylindrical vessel from the material, wherein the low-loss insulating portion of the cylindrical insulating insert faces the inner surface of the wall of the cylindrical vessel and the closed end thereof, while the high-loss portion of the cylindrical insulating insert faces the material in the cylindrical vessel, whereby rapid and uniform heating of the material is enhanced. A space is provided between the graded insulating cylindrical insert and the interior of the cylindrical vessel, and means are provided for circulating air through this space, such that the walls of the cylindrical vessel are cooled.

It is also preferred that the low-loss insulating portion of the insulating cylindrical insert includes aluminum oxide and the high-loss portion of the cylindrical insulating insert includes silicon carbide.

Benefits and advantages of the invention include the utilization of conventional microwave technology in a portable and scalable form for uniformly and rapidly heat microwave absorbing materials contained in drums to high temperatures for processing. The present invention may also be utilized for sterilization of shredded infectious medical waste which is transported through a cylindrical pipe-reactor in a continuous stream; that is, multimode microwave radiation can used to uniformly heat moving streams of material which can then be disposed of as municipal waste.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 3*a* shows the waveguide flange which attaches an exit of the beamsplitter shown in FIG. 1 hereof, FIG. 3*b* shows the circular hole iris, the diameter of which is adjustable to achieve the desired microwave transmission therethrough, and FIG. 3*c* shows the top or side flange which is affixed to the side or top of the cylindrical transition cavity, respectively.

FIG. 8*a* is a graph of the calculated temperature distribution of the material contents of a container for the superposition of cylindrical microwave modes shown in FIG. 7 hereof compared with the calculated temperature distribution which would be produced by utilizing the $TE_{11}$ mode alone, both as a function of the distance from the center of the container, while

DETAILED DESCRIPTION

Briefly, the present invention includes the conversion of $TE_{10}$-mode microwave radiation into multimode microwave radiation using a mode-converting cylindrical transition cavity for improving the electric field distribution in a cylindrical drum onto the open end of which the transition cavity is affixed, thereby generating uniform microwave heating of the material load contained in the drum. The rapid and uniform heating of material solids in the cylindrical drum will be further enhanced by using a layered silicon carbide/aluminum oxide cylindrical sleeve insert placed near to the inside walls and the bottom inside of the drum. If the high-dielectric-loss silicon carbide material is oriented towards the interior of the drum center and the low-loss alumina insulator material is disposed adjacent to the drum walls and the bottom, enhanced load material heating will be achieved, while the drum walls avoid significant heat transfer. An air-flow region will be maintained between the inside of the drum walls and the material sleeve insert to facilitate forced air circulation for further cooling the outer walls of the drum. Microwave frequencies between 0.915 GHz and 2.45 GHz will be employed, since high-power generators and waveguide are commonly available for these frequencies.

Figure 1:
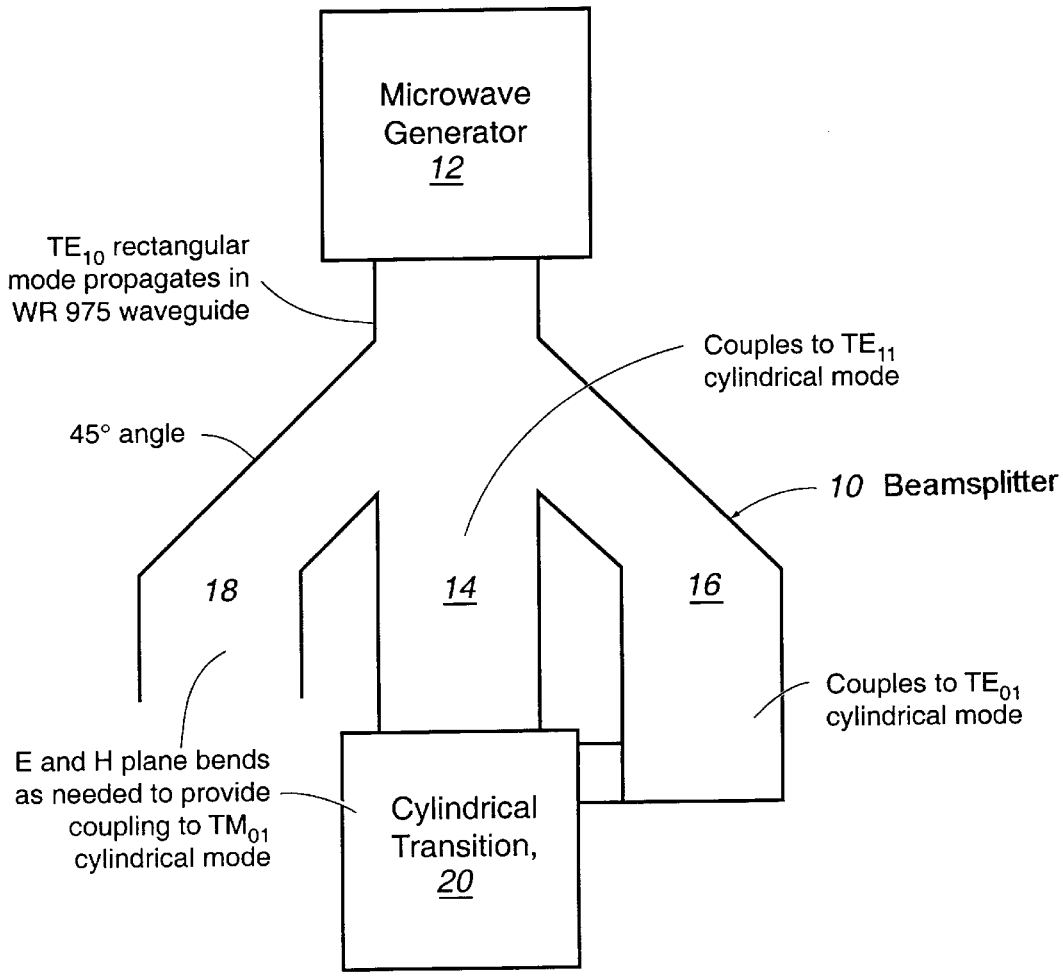
FIG. 1 is a schematic representation of the side view of the microwave beamsplitter of the present invention which divides $TE_{10}$ microwave radiation supplied by a microwave generator thereof into three $TE_{10}$ components.

Reference will now be made in detail to the present preferred embodiments of the invention, examples of which are illustrated in the accompanying drawings. Similar or identical structure is identified using identical callouts. Turning now to the drawings, FIG. 1 is a schematic representation of the side view of the microwave beamsplitter, 10, of the present invention which divides $TE_{10}$ microwave radiation supplied by microwave generator, 12, into three $TE_{10}$ components, 14, 16, and 18. It is anticipated the microwave generator 12 will be a 30–60 kW 0.915 GHz power source, and beamsplitter 10 will be constructed from WR 975 waveguide. For 2.45 GHz applications, the microwave generator should generate 50 kW of power into a type WR 284 waveguide. These frequencies were chosen since there is much commercially available microwave equipment, although other frequencies could be used. Microwave components, 14, 16, and 18 will be coupled into cylindrical transition, 20, from the top and two sides thereof such that $TE_{11}$, $TE_{01}$ and $TM_{01}$ cylindrical modes are generated therein.

Figure 2:
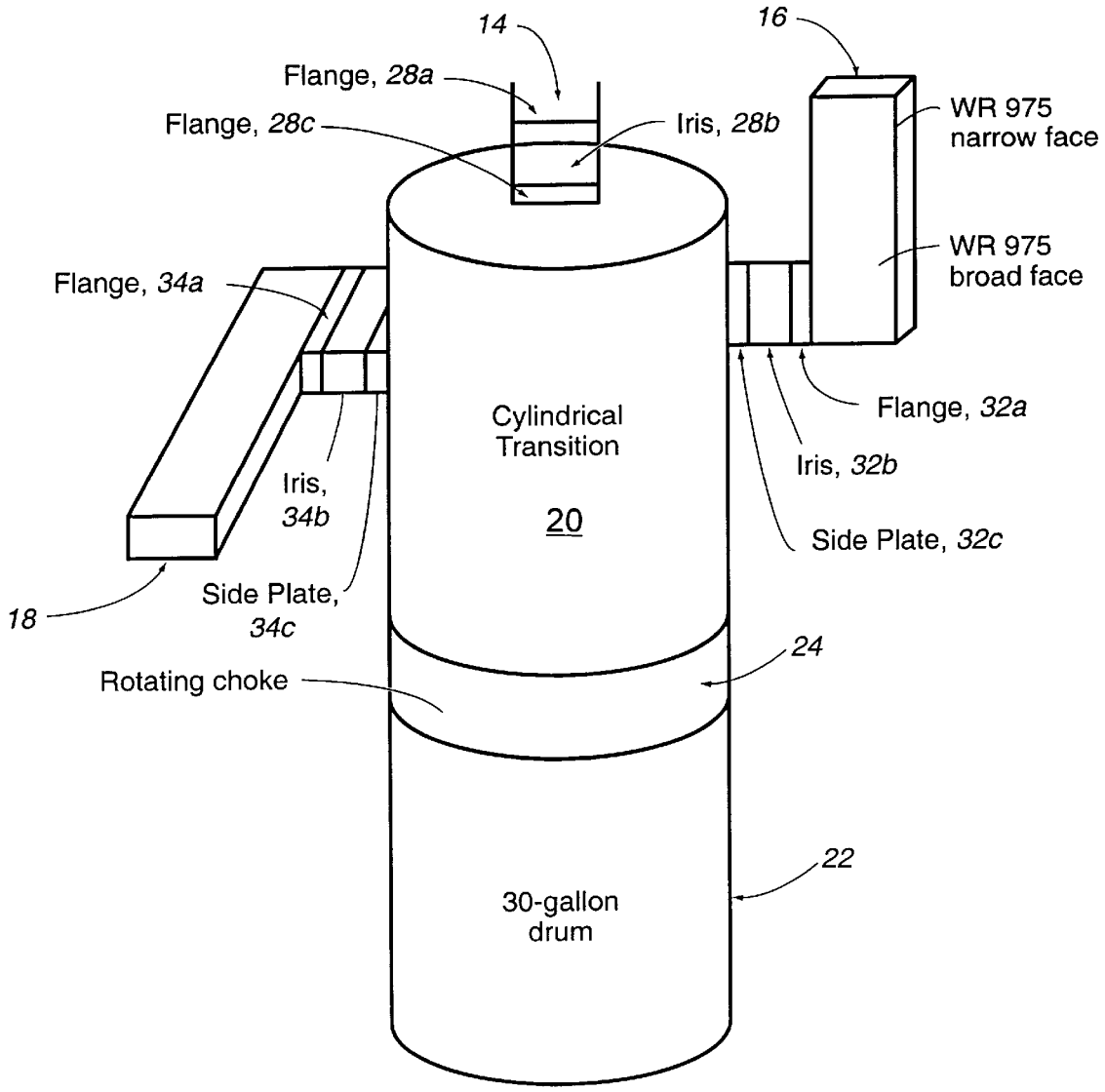
FIG. 2 is a schematic representation of a perspective view of the apparatus of the present invention showing the three microwave components of $TE_{10}$ microwave radiation supported by the beamsplitter of FIG. 1 hereof entering the cylindrical transition cavity of the apparatus from the top and sides such that $TE_{11}$, $TE_{01}$, and $TM_{01}$ cylindrical modes are generated therein and coupled to a cylindrical material container through a rotating choke.

FIG. 2 is a schematic representation of a perspective view of the apparatus of the present invention showing the three microwave components of $TE_{10}$ microwave radiation supported by the beamsplitter of FIG. 1 hereof entering cylindrical transition 20 which is coupled to cylindrical material container, 22, (10 ,30, or 55 gal. capacity) through the open end thereof, through rotatable choke, 24. The dimensions of the cylindrical transition which are calculated to provide the desired microwave modes for a 30 gal container are 14" long and 18.75" in diameter. The corresponding dimensions for a 30 gal container are 24" and 18.75", respectively. To achieve an energy deposition pattern in the material contained in container 22 which produces uniform heating of the material, multimode microwave radiation having a chosen pattern will be introduced into the material container. Adjustable flange/iris/plate couplers will be used to provide the appropriate mix of microwave modes. Variations in the angular dependence of the intensity about the axis of the transition can be removed by rotating the container, as will be further described in FIG. 9 hereof, the microwave coupling between the transition and the container being achieved through 6" long, 18.75" diameter rotatable choke 24.

Figure 3:
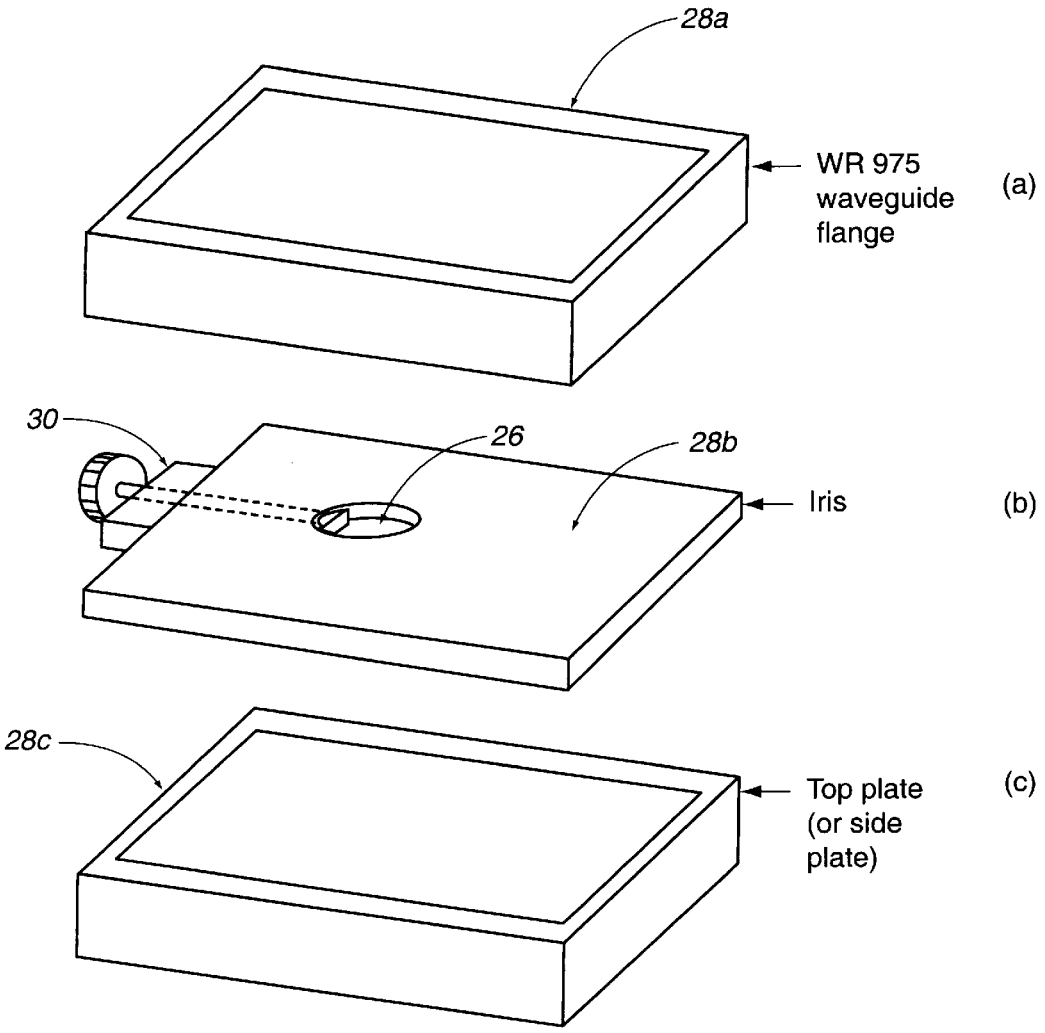
FIGS. 3*a*–3*c* are schematic representations of a perspective view of the adjustable microwave flange/iris/plate coupler for coupling a chosen amount of microwave energy into each of the three ports of the cylindrical transition cavity shown in FIG. 2 hereof, where

FIGS. 3*a*–3*c* are a schematic representations of a perspective view of the adjustable microwave flange/iris/plate coupler for coupling a chosen quantity of microwave energy into each of the three ports of the cylindrical transition cavity shown in FIG. 2 hereof, where FIG. 3*a* shows the waveguide flange which attaches to an exit of the beamsplitter shown in FIG. 1 hereof, FIG. 3*b* shows the circular hole iris, the diameter of which is adjustable to achieve the desired microwave intensity transmission therethrough, and FIG. 3*c* shows the top or side flange which is affixed to the side or top of the cylindrical transition cavity. Aperture, 26, in iris plate, 28*b* is adjustable using screw mechanism, 30. Returning to FIG. 2 hereof, although other intensity adjustable microwave coupling arrangements can be employed, an adjustable iris transition, 28*a*–28*c*, is shown as the interface between the WR975 waveguide of the beamsplitter for $TE_{10}$-mode component 14 and the top of cylindrical transition 20 for coupling this radiation into the transition as $TE_{11}$-mode excitation. Similarly, adjustable iris transition, 32*a*–32*c*, will be used to couple component 16 of the waveguide into the side of transition 20 such that the $TE_{01}$-mode is excited in the transition, and adjustable iris transition, 34*a*–34*c*, will be used to couple component 18 into the side of transition 20 such that the $TM_{01}$-mode is generated therein.

Figure 4A:
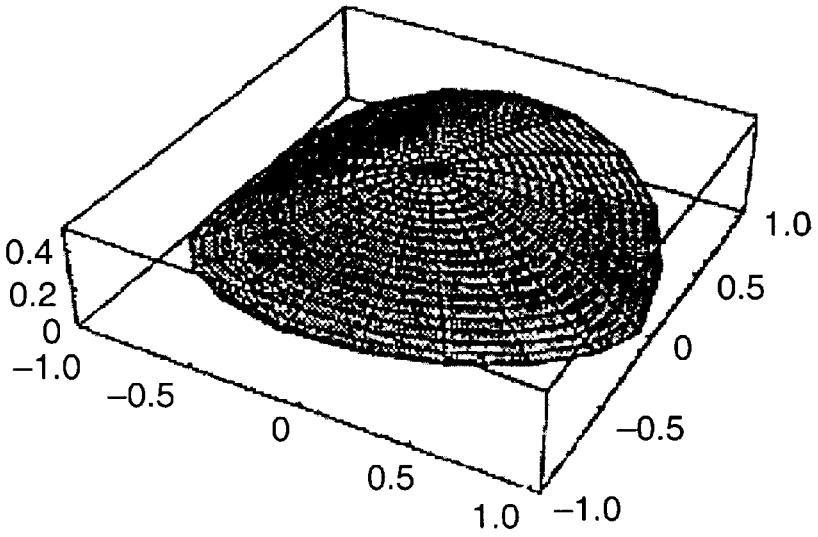
FIGS. 4*a* and 4*b* are graphs of the calculated normalized intensity of the $TE_{11}$- and $TE_{01}$-cylindrical mode microwave radiation, respectively, as a function of the radial distance from the center of a cylindrical container.
Figure 4B:
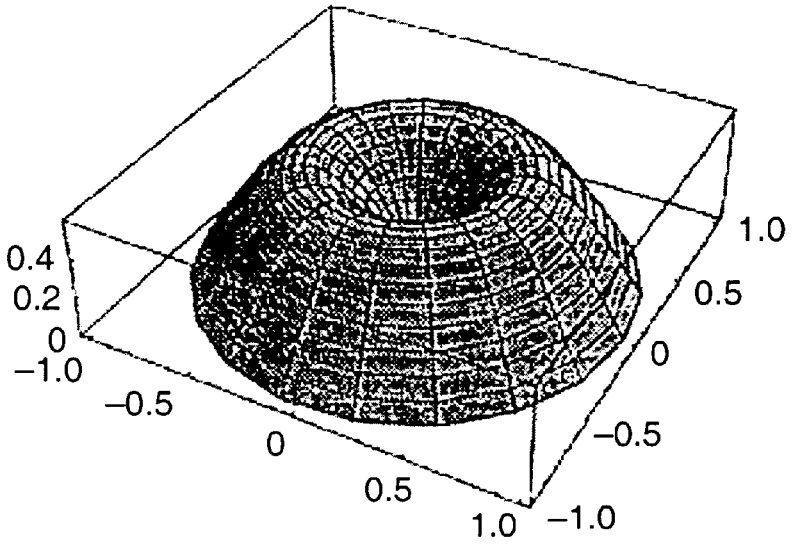

FIGS. 4*a* and 4*b* are graphs of the calculated normalized intensity of the $TE_{11}$- and $TE_{01}$-cylindrical mode microwave radiation, respectively, as a function of the radial distance from the center of a cylindrical container when these microwave modes are introduced through the transition according to the teachings of the present invention.

Figure 5A:
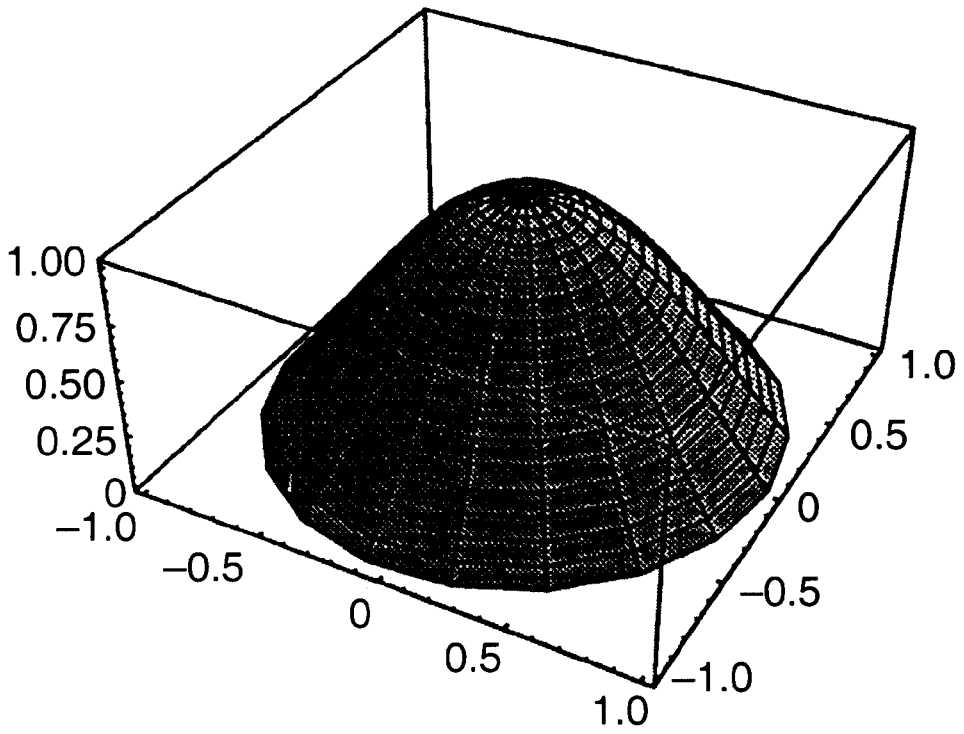
FIGS. 5*a* and 5*b* are graphs of the calculated normalized intensity of the $TM_{01}$-cylindrical mode microwave radiation, for z=0 and $z=\lambda g/8$, respectively, where z is the linear dimension of a cylindrical container measured from the top thereof downward, as a function of the radial distance from the center of the cylindrical container.
Figure 5B:
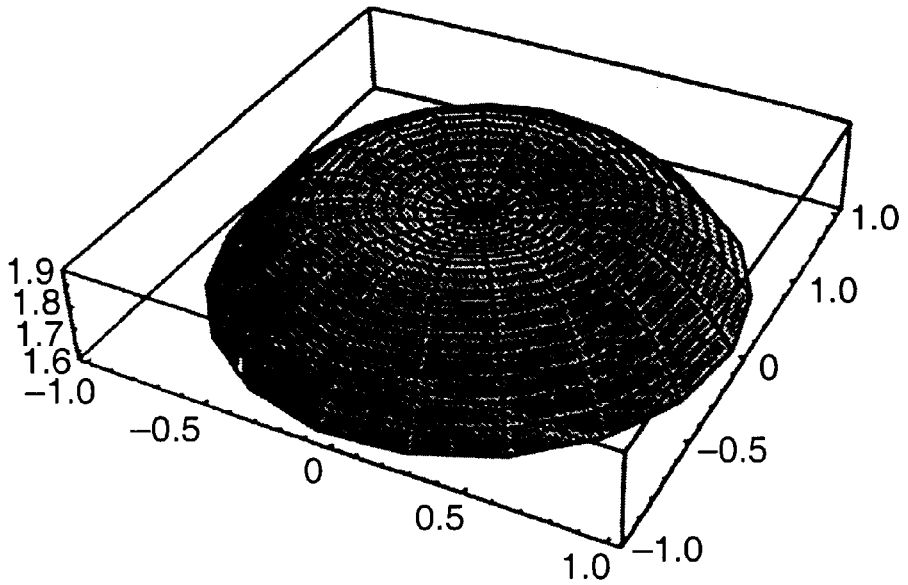
Figure 5C:
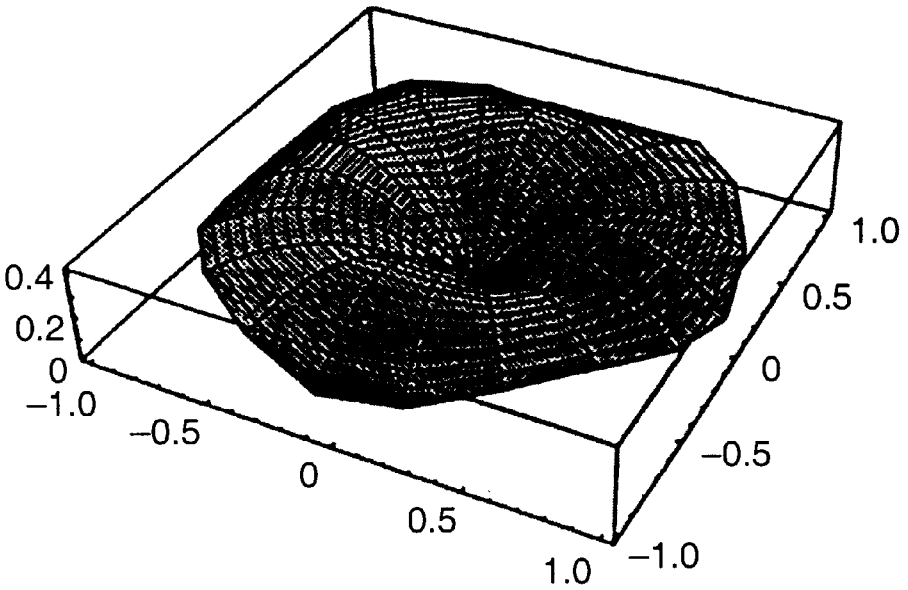
FIG. 5*c* is the graph of the normalized intensity of the $TE_{21}$-cylindrical mode microwave radiation as a function of radial distance from the center of the cylindrical container.

FIGS. 5*a* and 5*b* are graphs of the calculated normalized intensity of the $TM_{01}$-cylindrical mode microwave radiation, for z=0 and $z=\lambda_g/8$, respectively, where z is the linear dimension of a cylindrical container measured from the top thereof downward, as a function of the radial distance from the center of the cylindrical container when these modes are introduced through the transition according to the teachings of the present invention. FIG. 5*c* is the graph of the normalized intensity of the $TE_{21}$-cylindrical mode microwave radiation as a function of radial distance from the center of the cylindrical container. This mode was unexpectedly found to be present in the transition along with the $TE_{11}$-, $TE_{01}$-, and $TM_{01}$-modes when paper burn experiments were conducted. Although the shape of the intensity curves does not vary for different values of z for the TE-modes, significant variation occurs as a function of z for the TM-modes.

Figure 6:
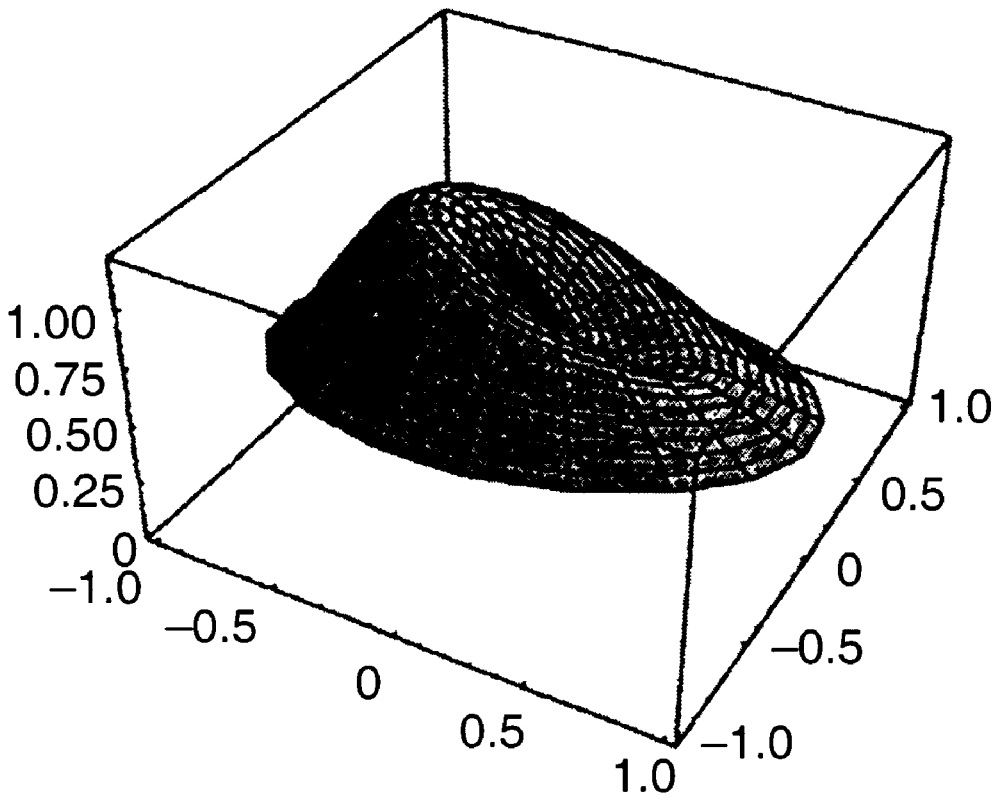
FIG. 6 is a graph of the calculated normalized intensity resulting from the superposition of equal intensities of $TE_{11}$-, $TE_{01}$- and $TM_{01}$-cylindrical modes of microwave radiation, as a function of radial distance from the center of a cylindrical container.

FIG. 6 is a graph of the calculated normalized intensity resulting from the superposition of equal intensities of $TE_{11}$-, $TE_{01}$- and $TM_{01}$-cylindrical modes of microwave radiation, as a function of radial distance from the center of a cylindrical container when these modes are introduced through the transition according to the teachings of the present invention.

Figure 7:
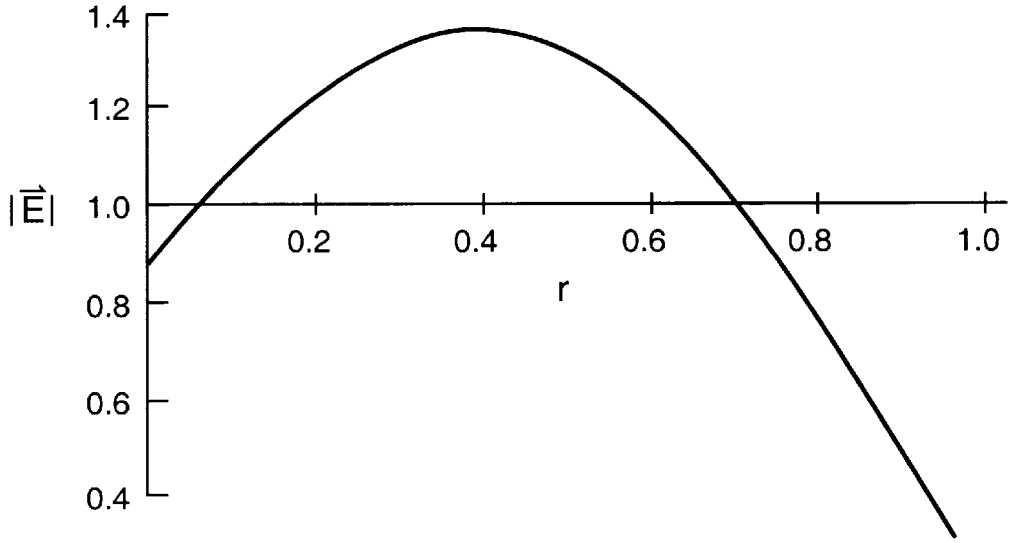
FIG. 7 is a graph of the calculated resultant electric field profile for a superposition of $TE_{11}$-, $TE_{01}$-, and $TM_{01}$-cylindrical microwave modes having their individual electric field intensities adjusted to be substantially equal, as a function of the radius measured from the center of a cylindrical container, and shows that the peak electric field is away from r=0.

FIG. 7 is a graph of the calculated resultant electric field profile for a superposition of $TE_{11}$-, $TE_{01}$-, and $TM_{01}$-cylindrical microwave modes having their individual intensities adjusted such that the intensity of each mode is substantially equal, as a function of the radius measured from the center of a cylindrical container when these modes are introduced through the transition according to the teachings of the present invention. The calculated results also assume identical phases for the modes. FIG. 7 shows that the peak electric field is away from r=0, which is the result of the presence of the $TE_{01}$-mode. The $TM_{01}$-mode provides substantially constant electric field as a function of radius, while the $TE_{11}$-mode has a significant electric field component at r=0. However, since all TE-modes have zero electric field at the outer boundary, a microwave-absorbing insert will be introduced into the container, as will be described hereinbelow. It should be noted that a uniform electric field distribution does not provide uniform heating; that is, it is calculated that a 1/r electric field distribution will provide uniform heating since, although a uniform field distribution gives rise to uniform power absorption by the materials in the container, heat transfer considerations tend to render the center of the container the hottest portion of the container for a uniform distribution. Since an exact 1/r pattern cannot be generated by mode mixing, the absorbing insert will be included to improve the heating pattern.

Figure 8A:
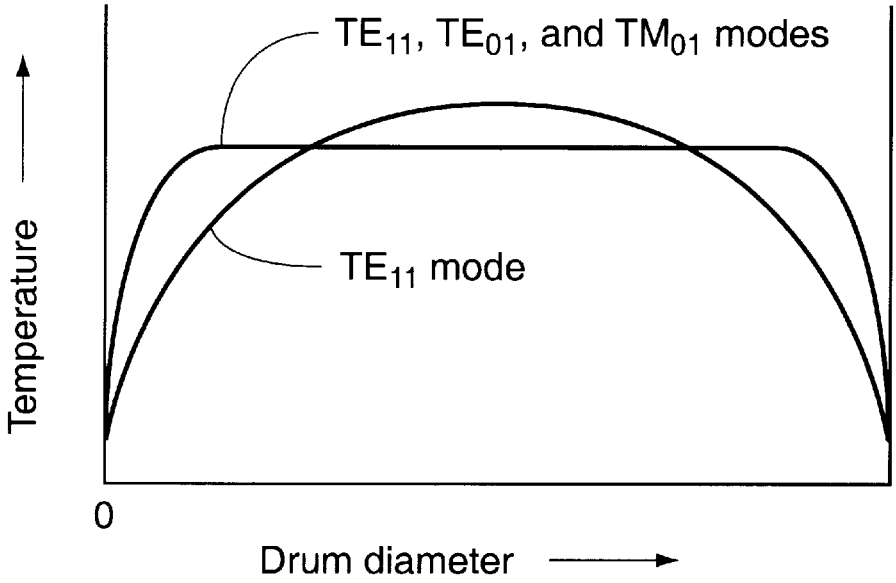
Figure 8B:
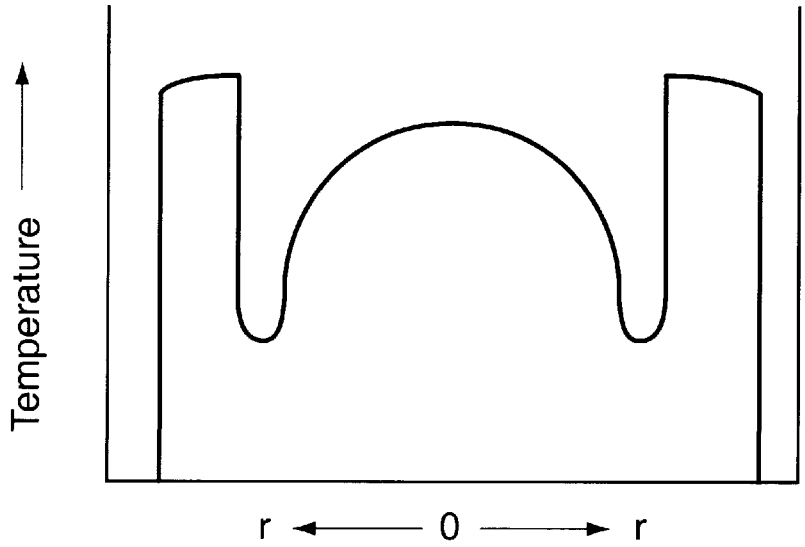
FIG. 8*b* is a graph of the calculated temperature distribution of the material contents of a container heated using the $TE_{11}$ mode alone where a microwave-absorbing dielectric sleeve has been inserted between the material to be heated and the container wall, as a function of the distance from the center of the cylindrical container.

FIG. 8*a* is a graph of the calculated temperature distribution of the contents of a container for the superposition of cylindrical microwave modes shown in FIG. 7 hereof compared with the calculated temperature distribution which would be produced by utilizing the $TE_{11}$ mode alone, both as a function of the distance from the center of the container. FIG. 8*b* is a graph of the calculated temperature distribution of the contents of a container heated using the $TE_{11}$ mode alone where a microwave-absorbing dielectric sleeve has been inserted between the material to be heated and the container wall, as a function of the distance from the center of the cylindrical container.

It is predicted that an approximately 0.5 in. thick, microwave-absorbing insert disposed in close proximity to the interior walls of the container such that an approximate 0.5 in. spacing remains between the walls of the container and the bottom thereof and the insert, should improve the uniformity of heating in the container and insulate the walls thereof from excessive heating. The inside of the insert (that is, the portion thereof facing the center of the container) would include 0.25 in. thick layer of SiC, while the remaining 0.25 in. would be $Al_2O_3$ (facing the container walls and bottom). The sleeve could also be a graded composition starting from pure $Al_2O_3$ on the outside and ending with pure SiC on the inside. The alumina serves as a thermal insulator and does not significantly absorb microwave radiation, so it remains relatively cool and shields the container walls. The silicon carbide layer, by contrast, is a strong dielectric absorber at 0.915 GHz microwave frequency and is rapidly heated to high temperature by the microwave radiation, thereby assisting in reducing heating non-uniformities in the material near the walls of the container. To further improve heating, approximately 10 wt. % of SiC particulate might be added to the material before processing. An alternate waste additive is magnetite ($Fe_3O_4$) since this material is inexpensive and readily available, and is a strong absorber of 0.915 GHz microwave radiation.

To demonstrate selective heating of SiC versus $Al_2O_3$, cups were fabricated from pure $Al_2O_3$ and $Al_2O_3$ having 10% by weight of SiC admixed therein, and heated in a commercial microwave oven. The temperature increases for the two materials were 7° C. and 18° C., respectively, demonstrating the expected increased heating with SiC present.

Figure 9:
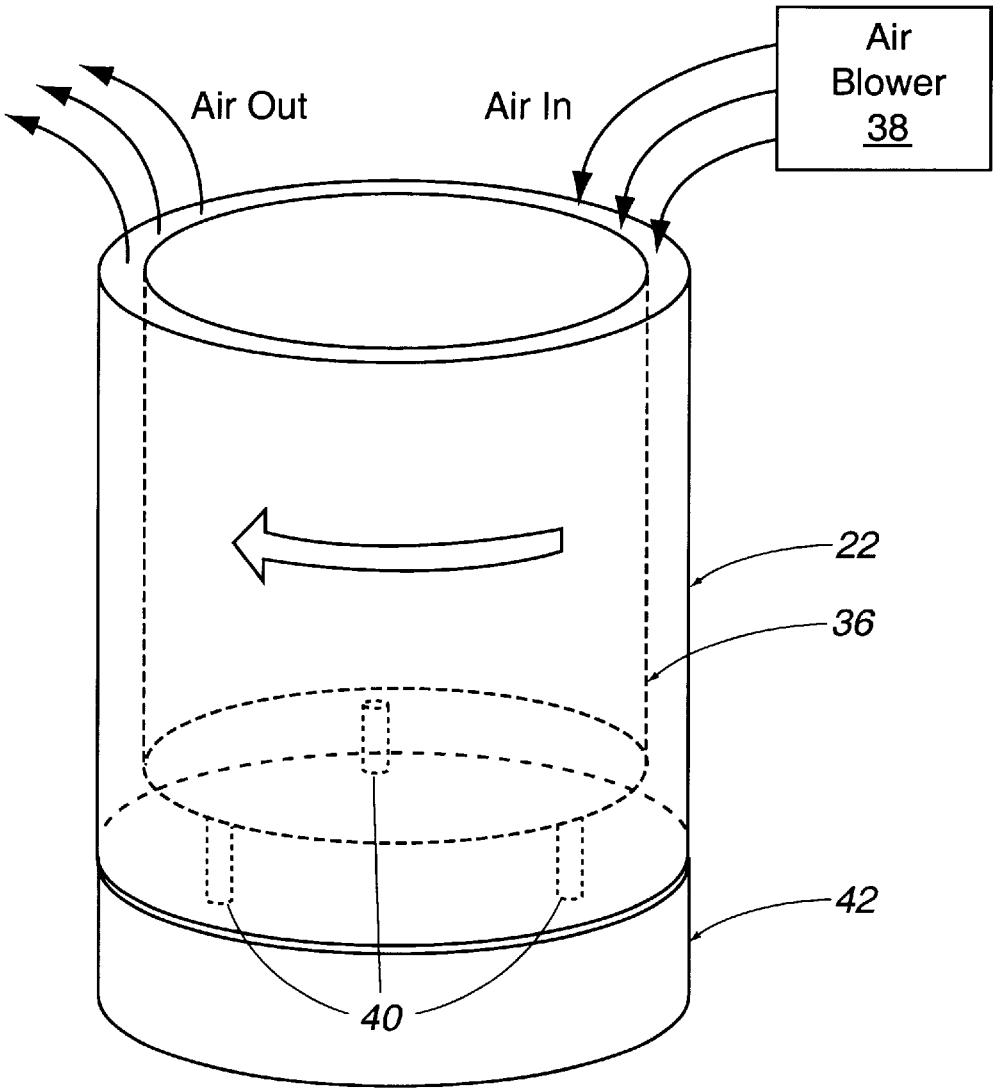
FIG. 9 is a schematic representation of the side view of a material-containing vessel showing the location of the dielectric insert, an air blower for air cooling the volume between the ceramic insert and the walls of the container, and means for rotating the cylinder to compensate for any nonuniformities in the angular dependence of the microwave field and in the material fill.

FIG. 9 is a schematic representation of the side view of another embodiment of the invention, illustrating the location of dielectric insert, 36, which will be filled with the material to be processed. Air blower, 38, drives air through the volume between the insert and the walls of container 22, and is expected to keep the container walls at near room temperature during the material processing. Feet, 40, keep the closed, lower end of the insert from coming in contact with the bottom of the container. Drum rotating apparatus, 42, permits the loaded drum to be rotated as discussed hereinabove.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for generating uniform heating in material contained in a cylindrical vessel, which comprises in combination:

(a) means for generating $TE_{10}$-mode microwave radiation;

(b) a cylindrical microwave transition having an axis, a side wall, an open end and a closed end parallel thereto, both ends being perpendicular to the axis, the open end thereof being disposed in the vicinity of an open end of the cylindrical vessel and substantially coextensive therewith such that the axis of said transition is coaxial with the axis of the vessel, for coupling microwave radiation into said vessel;

(c) first means for directing the $TE_{10}$-mode microwave radiation from said generating means through the closed end of said transition and along the axis of said transition and for adjusting the intensity thereof, whereby $TE_{11}$-mode microwave radiation having adjustable intensity is excited therein;

(d) second means for directing the $TE_{10}$-mode radiation from said generating means through the side wall of said transition and for adjusting the intensity thereof, such that the electric field of the microwave radiation is perpendicular to the axis of said transition, whereby $TE_{01}$-mode microwave radiation having adjustable intensity is excited therein; and (e) third means for directing the $TE_{10}$-mode radiation from said generating means through the side wall of said transition and for adjusting the intensity thereof, such that the electric field of the microwave radiation is parallel to the axis of said cylindrical transition, whereby $TM_{01}$-mode microwave radiation having adjustable intensity is excited therein; whereby the $TE_{11}$-, $TE_{01}$-, and $TM_{01}$-mode microwave radiation generated in said transition and having adjustable intensity are simultaneously coupled into the material contained in the cylindrical vessel such that the material is uniformly heated.

2. The apparatus as described in claim 1, wherein said $TE_{10}$-mode microwave radiation has a frequency between 0.915 and 2.45 GHz.

3. The apparatus as described in claim 1, wherein said first means for directing the $TE_{10}$-mode radiation from said generating means through the closed end of said transition and for adjusting the intensity thereof includes a first iris adapted to receive the $TE_{10}$-mode radiation and having an adjustable aperture.

4. The apparatus as described in claim 1, wherein said second means for directing the $TE_{10}$-mode radiation from said generating means through the side wall of said transition and for adjusting the intensity thereof includes a second iris adapted to receive the $TE_{10}$-mode radiation and having an adjustable aperture.

5. The apparatus as described in claim 1, wherein said third means for directing the $TE_{10}$-mode radiation from said generating means through the side wall of said transition and for adjusting the intensity thereof includes a third iris adapted to receive the $TE_{10}$mode radiation and having an adjustable aperture.

6. The apparatus as described in claim 1, further comprising a poor microwave radiation absorbing insulating cylindrical insert having a closed end disposed within the cylindrical vessel such that the inside surface of the cylindrical walls of the cylindrical vessel and the closed end of the cylindrical vessel are separated from the material in said cylindrical vessel by said insulating cylindrical insert, and a volume formed thereby.

7. The apparatus as described in claim 6, wherein said insulating cylindrical insert is fabricated from aluminum oxide.

8. The apparatus as described in claim 6, further comprising means for circulating air through the volume formed between the inside of said cylindrical vessel and said cylindrical insert, whereby the walls of said cylindrical vessel are cooled.

9. The apparatus as described in claim 6, further comprising a highly microwave radiation absorbing cylindrical insert having a closed end and disposed within said insulating cylindrical insert such that the inside surface of the cylindrical walls of said insulating insert and the closed end of said insulating insert are separated from the material in the cylindrical vessel by said highly microwave radiation absorbing cylindrical insert.

10. The apparatus as described in claim, wherein said highly microwave radiation absorbing cylindrical insert is fabricated from silicon carbide.

11. The apparatus as described in claim 9, further comprising means for circulating air through the volume formed between the inside of said cylindrical vessel and said cylindrical insert, whereby the walls of said cylindrical vessel are cooled.

12. The apparatus as described in claim 1, further comprising a rotatable choke disposed between said cylindrical microwave transition and said cylindrical vessel adapted for transmitting microwave radiation therebetween, and means for rotating said cylindrical vessel to further enhance the uniformity of heating of the material therein.

13. The apparatus as described in claim 1, wherein $TE_{21}$-mode microwave radiation is generated in said cylindrical microwave transition.

* * * * *